US011515103B2

(12) United States Patent
Andreyo

(10) Patent No.: US 11,515,103 B2
(45) Date of Patent: Nov. 29, 2022

(54) HIGH VOLTAGE SWITCH WITH CONDENSATION PREVENTING BEARING ASSEMBLY AND METHOD THEREFOR

(71) Applicant: CLEAVELAND/PRICE INC., Trafford, PA (US)

(72) Inventor: Joseph K. Andreyo, Irwin, PA (US)

(73) Assignee: Cleaveland/Price Inc., Trafford, PA (US)

( * ) Notice: Subject to any disclaimer, the term of this patent is extended or adjusted under 35 U.S.C. 154(b) by 136 days.

(21) Appl. No.: 17/166,496

(22) Filed: Feb. 3, 2021

(65) Prior Publication Data

US 2021/0391124 A1 Dec. 16, 2021

Related U.S. Application Data

(60) Provisional application No. 63/039,038, filed on Jun. 15, 2020.

(51) Int. Cl.
*H01H 9/04* (2006.01)
*H01H 3/32* (2006.01)

(52) U.S. Cl.
CPC ..... *H01H 9/04* (2013.01); *H01H 3/32* (2013.01); *H01H 2003/326* (2013.01)

(58) Field of Classification Search
CPC ..... H01H 9/04; H01H 3/32; H01H 2003/326
USPC ..... 200/48 R
See application file for complete search history.

(56) References Cited

U.S. PATENT DOCUMENTS 2,878,331 A * 3/1959 Fjellstedt ..... H01H 3/46 200/48 R
8,734,573 B2 5/2014 Ono et al.
10,242,825 B1 * 3/2019 Kowalik ..... H01H 33/66207
2020/0388453 A1 * 12/2020 Swing, III ..... H01H 31/20

OTHER PUBLICATIONS

Cleaveland/Price Inc. Bulletin DB-A06BH09, entitled "Type V2-CA Aluminum Vertical Break Swich 115-230 kV, 600—3000 A.", six (6) pages.

* cited by examiner

*Primary Examiner* — Edwin A. Leon
*Assistant Examiner* — Iman Malakooti
(74) *Attorney, Agent, or Firm* — Ronald S. Lombard

(57) ABSTRACT

A high voltage electric disconnect switch having a rotatable switch blade in operative arrangement with a rotatable high voltage electrical insulator. A rotating bearing assembly in operative supporting arrangement with a rotatable shaft. The bearing assembly containing corrodible ball bearing assemblies including associated corrodible ball bearing races. The rotatable insulator is operatively mounted to the rotatable shaft. The rotatable shaft has a lower rotatable shaft portion contacting the corrodible ball bearing assemblies housed within a sealed housing of the bearing assembly. An air permeable hydrophobic membrane mounted in a membrane assembly is mounted in an aperture of the housing to eliminate condensing humidity within the housing, thereby preventing corrosion of the corrodible ball bearings and races, freezing water, and lubrication degradation by keeping the surfaces dry to prevent switch failure.

13 Claims, 4 Drawing Sheets

HIGH VOLTAGE SWITCH WITH CONDENSATION PREVENTING BEARING ASSEMBLY AND METHOD THEREFOR

CROSS-REFERENCE TO RELATED APPLICATION

This is application claims the benefit of U.S. Provisional Application No. 63/039,038 filed Jun. 15, 2020, which is incorporated herein by reference in its entirety.

BACKGROUND OF THE INVENTION

The present invention relates generally to a disconnect switch for high voltage electrical applications, and in particular, to such a high voltage disconnect switch having a bearing assembly for supporting a rotating high voltage insulator. Such a high voltage disconnect switch has one or more rotating switch blades where each switch blade is caused to rotate by a respective rotating high voltage insulator. Such a bearing assembly includes ball bearings or rollers and/or races comprised of corrodible or non-corrodible material for engaging a rotatable shaft of the rotating high voltage insulator. Typically, such existing bearing assemblies have, for example, ball bearings or rollers that ride in inner and outer races that are contained within a switch bearing housing. The rotatable shaft supporting and extending coaxially from the rotating high voltage insulator is operatively arranged; and partially housed within the switch bearing housing.

Non-corrodible ball bearings or rollers and associated races for such bearing assemblies have been developed over the years, made of non-corrodible material such as ceramic or beryllium copper or 300 series stainless steel in attempt to prevent corrosion within the switch bearing housing due to condensation occurring within the housing. Non-corrodible bearings were developed in an attempt to overcome the corrosion problem with corrodible ball bearings or rollers and associated races. However, such non-corrodible are typically not hard enough to prevent indentations of the balls into the races.

Typically, steel ball bearings or rollers and/or races of such bearing assemblies used in the electrical power utility industry are made of corrodible steel, such as 51200 & 440C. It is has long been known in the electrical power utility industry, that existing bearing assembly designs cannot eliminate condensing humidity, i.e., water, and, therefore, do not protect such corrodible ball bearings from corrosion due to condensation occurring within the switch bearing housing in outdoor use which may result in failure of the high voltage switch. Therefore, existing steel ball bearing systems are typically housed within a switch bearing housing chamber of the bearing assembly that is packed with grease to prevent corrosion of the corrodible steel ball bearings or rollers and/or their associated corrodible steel races.

The seals of such a sealed system of the existing bearing assemblies, whether comprised of non-corrodible or corrodible components are subjected to air pressure differentials that allow water to leak through the seals of an enclosing switch bearing housing into the housing chamber. It has been found that the invasive water then becomes trapped inside the housing chamber and may result in freezing of the water in the winter preventing rotation of the switch insulator. Also, in the case of bearing assemblies with corrodible components, trapped water is detrimental to protecting against corrosion and contamination of, for example, steel ball bearings and their associated steel races. Also, in the case of existing bearing assemblies comprising corrodible components any packed grease after a period of time turns to sludge due to the water infiltration and therefore the grease no longer adheres to the metal surfaces and does not prevent any corrosion.

An example of such an existing bearing system used with a high voltage disconnect vertical break switch is disclosed in Bulletin DB-A06BH09, entitled "Type V2-CA Aluminum Vertical Break Switch 115-230 kV, 600-3000 A, by Cleaveland/Price Inc., the present assignee, which is incorporated herein by reference in its entirety as though fully set forth. Although this bearing system uses an individually sealed ball bearing assembly for carrying the rotating insulator, it has been found problematic because of the potential for trapped water within the bearing assembly housing. The ball bearing assembly of this bearing system is contained in a chamber enclosing air within a sealed grease packed housing. Even though the housing is sealed it is still susceptible to corrosion of the steel ball bearings and steel races because of condensing humidity resulting in trapped water. The corrosion of the bearings causes the bearings to seize up to the point that the switch will not open or close, which has been an industry wide problem.

It is therefore an object of the present invention to develop a bearing system for a high voltage disconnect switch having rotating insulators that eliminates the problems of ball bearings or rollers and associated races, freezing due to trapped water, having their lubricant destroyed by trapped water, and in the case of corrodible components eliminating the corrosion problem of the prior art corrodible components.

SUMMARY OF THE INVENTION

The present invention provides a solution to the problems of the described prior art bearing systems for a high voltage disconnect switch having one or more rotating insulators. It has been found that the problem of the prior art bearing assembly permitting condensing humidity, i.e., water, to leak through seals of the housing containing the bearing system due to air pressure differentials surrounding the seals can be eliminated. The invention utilizes an air permeable hydrophobic membrane that is inherently liquid repellent to vent the housing enclosing the chamber. The air permeable hydrophobic membrane is preferably comprised of a polymer. The membrane allows air to flow into the housing and enclosed chamber but prevents condensation of the humidity inside the chamber.

The air permeable hydrophobic membrane only allows air flow to flow in or out of the chamber. This air exchange prevents any pressure differentials from inside the chamber relative to the outside ambient air. If a differential of negative pressure inside the chamber were to exist, it would draw water past the seals and into the chamber where it would be trapped and therefore would cause condensing humidity inside the chamber. Without trapped water or condensing humidity on any steel ball bearing or steel race surface inside the chamber the described problems are corrected as shown by repeated tests. The membrane keeps the steel ball bearings dry and therefore prevents corrosion and contamination of the steel ball bearing and associated steel races. After over one year of outdoor testing of the present invention, without any additional protection of the ball bearing assemblies, such as protection with oil or grease, the corrodible steel ball bearings were found free of any corrosion or contaminants. In addition to proving that the bearing assembly of the present invention including the membrane works, an identical bearing assembly without the membrane, but with a small plain hole through the chamber was tested outdoors for two months and it showed that the steel ball bearings of the bearing assembly were corroded. Both tests were run with 52100 bearing steel, which is corrodible steel. The only difference between the two tests was the addition of the membrane instead of the small plain hole, proving that the membrane prevented condensation and corrosion of the steel. Even though the small hole allowed air flow, it did not prevent condensation of the moist air which the membrane prevents.

The air permeable hydrophobic membrane of the present invention is affixed in a membrane vent housing aperture passing through the housing enclosing the chamber. The membrane allows air flow to equalize the pressure inside the housing and chamber to the ambient pressure outside the housing. The membrane vent housing aperture, is preferably positioned in the side of the housing, which is adapted to receive a membrane vent housing. The membrane vent housing encloses the air permeable hydrophobic membrane.

The housing of the bearing assembly of the present invention includes a pair of upper and lower corrodible steel bearing assemblies operatively arranged around a lower portion of a support shaft contained within the housing for supporting the rotatable insulator. Within the housing the axial chamber is sealed but vented with the polymer air permeable hydrophobic membrane that ensures that condensing of the moist air within the chamber is prevented, thus keeping the steel ball bearings dry and therefore preventing corrosion and contamination of the steel ball bearings and their associated steel races. The air permeable hydrophobic membrane prevents condensation and the pressure differentials that fill the bearing assembly housing with water. The membrane prevents the pressure differentials that causes a "pumping action" on prior art bearings that pump moist air past the seals, thus causing the corrosion. The membrane keeps the chamber dry and free of water and actually expels any water from the housing. The membrane eliminates the freezing of water problem within the chamber since there is no water. The membrane prevents deterioration of any lubricant coating of the bearings or rollers and associated races by inhibiting water infiltration.

The upper and lower corrodible steel bearing assemblies each include oppositely disposed inner and outer steel races, each having a plurality of ball bearings operatively positioned between corresponding inner and outer races. The upper corrodible steel bearing assembly is disposed in contacting relationship around the circumference of an upper section of the lower portion of the support shaft. The lower corrodible steel bearing assembly is disposed in contacting relationship around the circumference of a lower section of the lower portion of the support shaft. The axial chamber is a hollow space contained within the bearing assembly housing. The axial chamber of the housing surrounds the lower portion of the shaft. The housing is cylindrical and surrounds the lower shaft portion with the axial chamber contained between the housing and the shaft. The bearing assembly includes a top plate attached to an upper end of the housing and a bottom plate attached to the lower end of the housing. The inner races of each upper and lower corrodible steel bearing assembly are operatively attached to the lower portion of the shaft. The outer races of each upper and lower corrodible steel bearing assembly are attached in fixed position to the housing. Thus, the rotating insulator support shaft is permitted to rotate with reduced friction by riding on the steel ball bearings of the upper and lower corrodible steel bearing assemblies.

The top plate has an aperture passing through it for permitting the rotating insulator support shaft to exit the housing. A top flange bracket is attached to the top plate and surrounds the circumference of the shaft. The top flange bracket retains a double seal that seals the axial chamber with respect to the portion of the shaft exiting via the top flange bracket.

The bottom of the rotating insulator support shaft is supported by the bottom plate. The bottom plate is sealed to the housing by a lower gasket seal that is positioned between the lower end of the housing and the bottom plate. The lower gasket seal is preferably made of a weather resistant material. The lower corrodible steel bearing assembly also abuts the bottom plate. Also included is another seal positioned above the double seals adhering to the shaft and rides on the flange bracket surface as the shaft rotates. This seal is preferably made of a weather resistant material.

The air permeable condensation preventing membrane vent preferably includes a membrane vent housing mounted in operative engagement with an opening in the sealed bearing housing for carrying the air permeable hydrophobic membrane. A membrane vent housing cap is also preferably included in operative arrangement with the air permeable hydrophobic membrane. The housing cap is configured to protect the air permeable hydrophobic membrane from freezing rain and/or snow and/or dirt that can clog the air permeable hydrophobic membrane.

The membrane vent housing preferably has a membrane vent channel passing through it in fluid communication with chamber of the sealed bearing housing. The air permeable hydrophobic membrane is in operative arrangement with the membrane vent housing channel and the interior of the sealed bearing housing.

The corrodible metal ball bearings or metal rollers and/or metal races can be 410 series corrodible stainless steel, iron or an alloy or corrodible steel or any metal or may be non-corrodible ceramic or beryllium copper. A method for practicing the invention is also disclosed.

BRIEF DESCRIPTION OF THE DRAWINGS

Further details of the invention will become clear from the following drawings and descriptions of the illustrative embodiments represented schematically in the drawings, in which.

DETAILED DESCRIPTION OF THE PARTICULAR EMBODIMENTS

Figure 1:
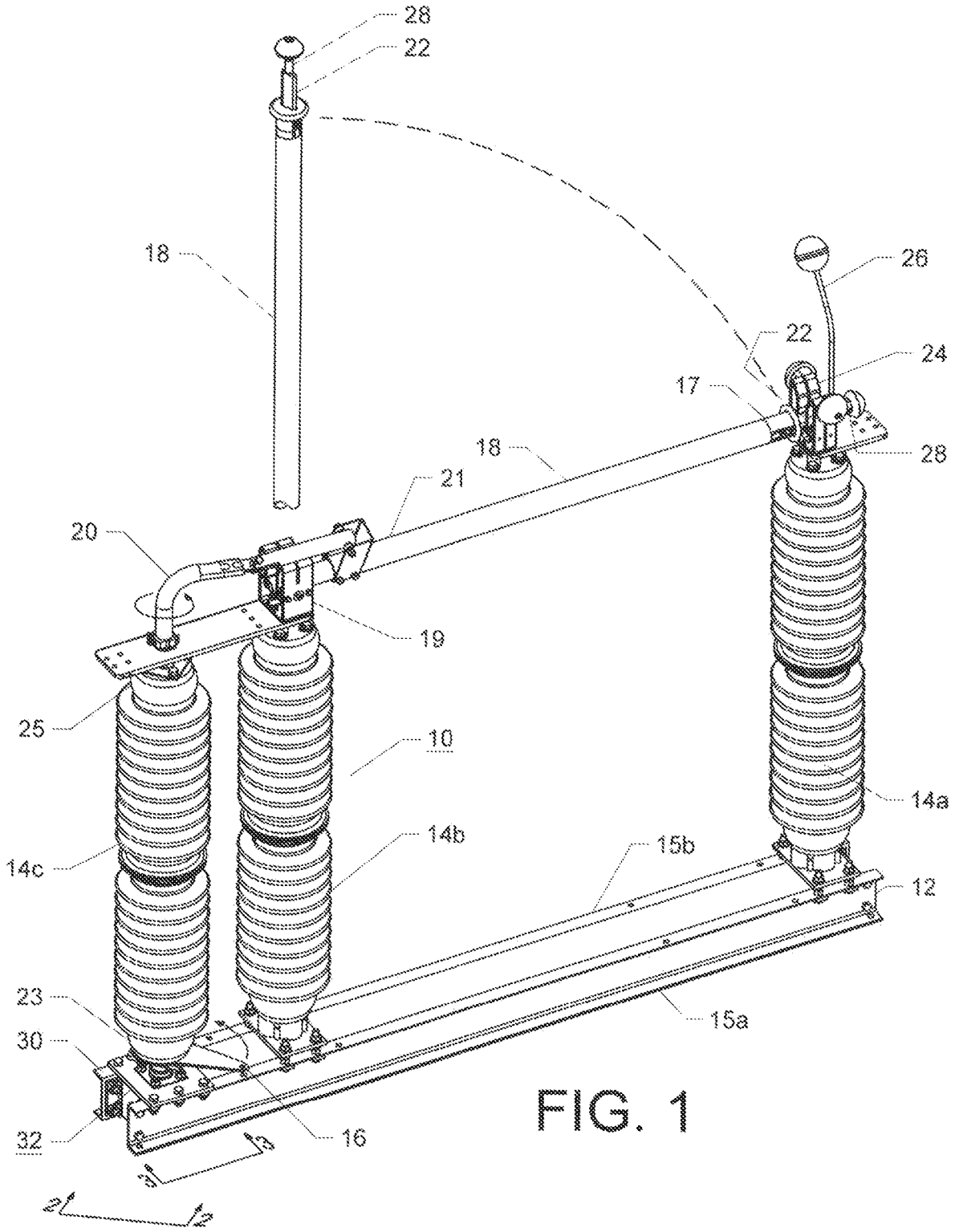
FIG. 1 is a perspective view of a high voltage vertical break disconnect switch of the present invention showing the switch blade in the electrically closed operating position and dashed lines showing the switch blade in the electrically open operating position.

FIG. 1 shows a high voltage disconnect switch 10 which in this embodiment is depicted as a vertical break type switch. Of course, the present invention applies equally to other types of a high voltage disconnect switch, such as, a side break switch, double break switch or a center break switch, for example. These types of disconnect switches are referenced in IEEE Std. C37.30.1-2011 relating to IEEE Standard Requirements for AC High Voltage Air Switches Rated Above 1000 Volts. The vertical high voltage disconnect switch depicted in FIG. 1, includes a base 12 to which is attached two stationary insulators 14*a* and 14*b* and a rotatable insulator 14*c*. The base 12 is comprised of two parallel oppositely disposed flanged beams 15*a*, 15*b* with a U-shaped cross-section.

A rotatable switch blade 18 is hinged to a hinge 19 at the proximal end 21 of the switch blade 18. A lever 16 is attached to the bottom 23 of the rotatable insulator 14*c* by which a force can be exerted either manually or by motor mechanism to rotate the insulator 14*c* and cause the high voltage disconnect switch to open the switch blade 18. Extending from the top 25 of the rotatable insulator 14*c* an operating crank 20 is attached to the switch blade 18 as shown in FIG. 1. When lever 16 is caused to rotate the operating crank 20 imparts a motion to the switch blade 18 to cause it to first rotate and then raise vertically as shown by the dashed line to cause blade tip contact 22 at the distal end 17 of the switch blade 18 to be released from contact with the jaw fingers 24. A stationary arc horn 26 is in sliding contact with a moving arc horn contact 28. As the switch 10 is opening the stationary arc horn 26 which had been in contact with moving arc horn 28 attached to the switch blade 18 is caused to slide out of contact with the stationary arc horn 26. Such an arrangement is well known in the art.

Figure 2:
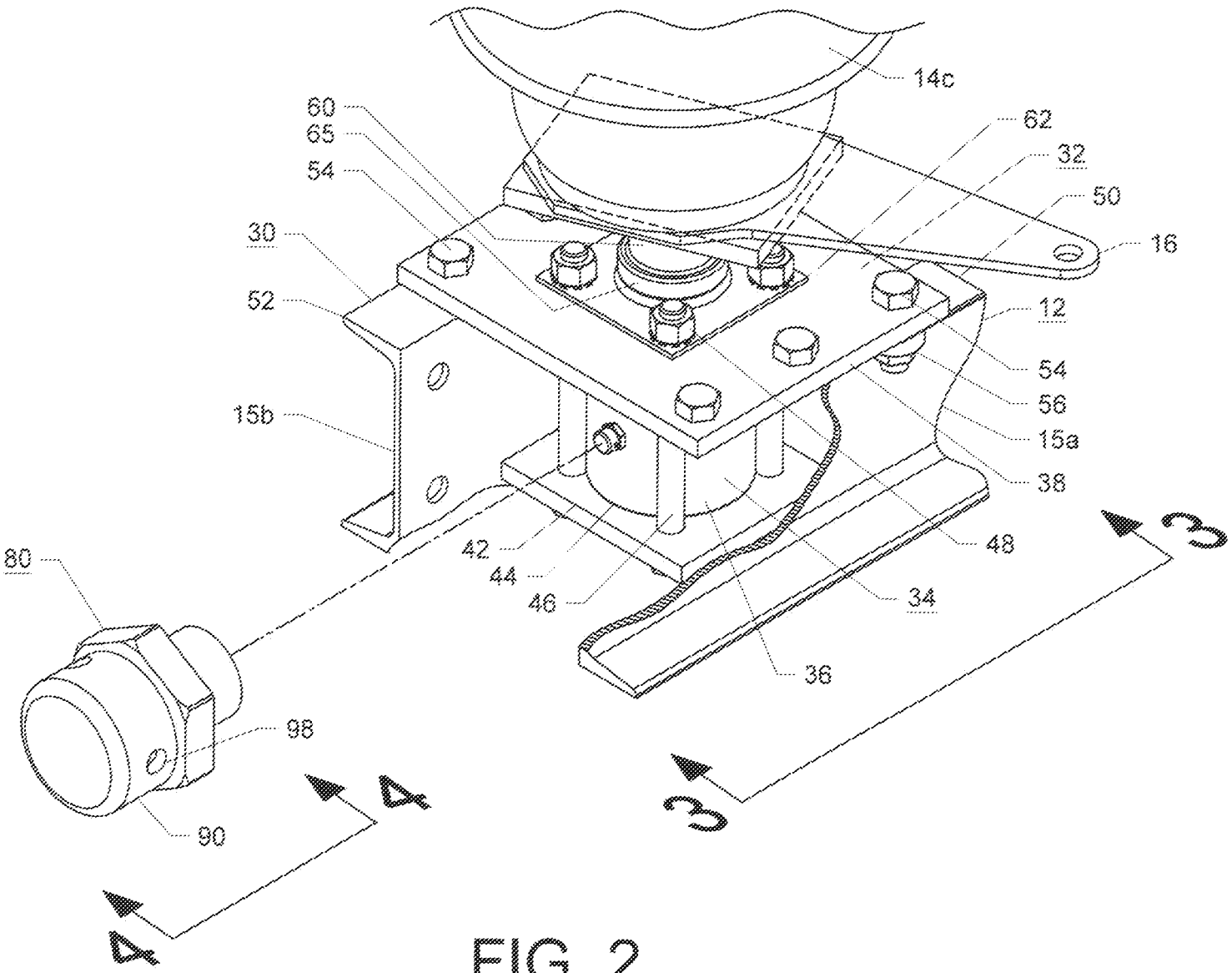
FIG. 2 is a perspective view, partially broken away, taken along the line '2'-'2' of FIG. 1 with an enlarged "pull-out" view of the membrane vent mounting.

FIG. 2 is a perspective view, partially cut away, taken along the line of '2'-'2' of FIG. 1 showing one end 30 of switch base 12 with a rotating bearing assembly 32 supporting the rotating insulator 14*c*. The bearing assembly 32 is operatively mounted between the first U-shaped flanged beam 15*a* and the second U-shaped flanged beam 15*b* at the one end 30 of the switch base 12.

Figure 3:
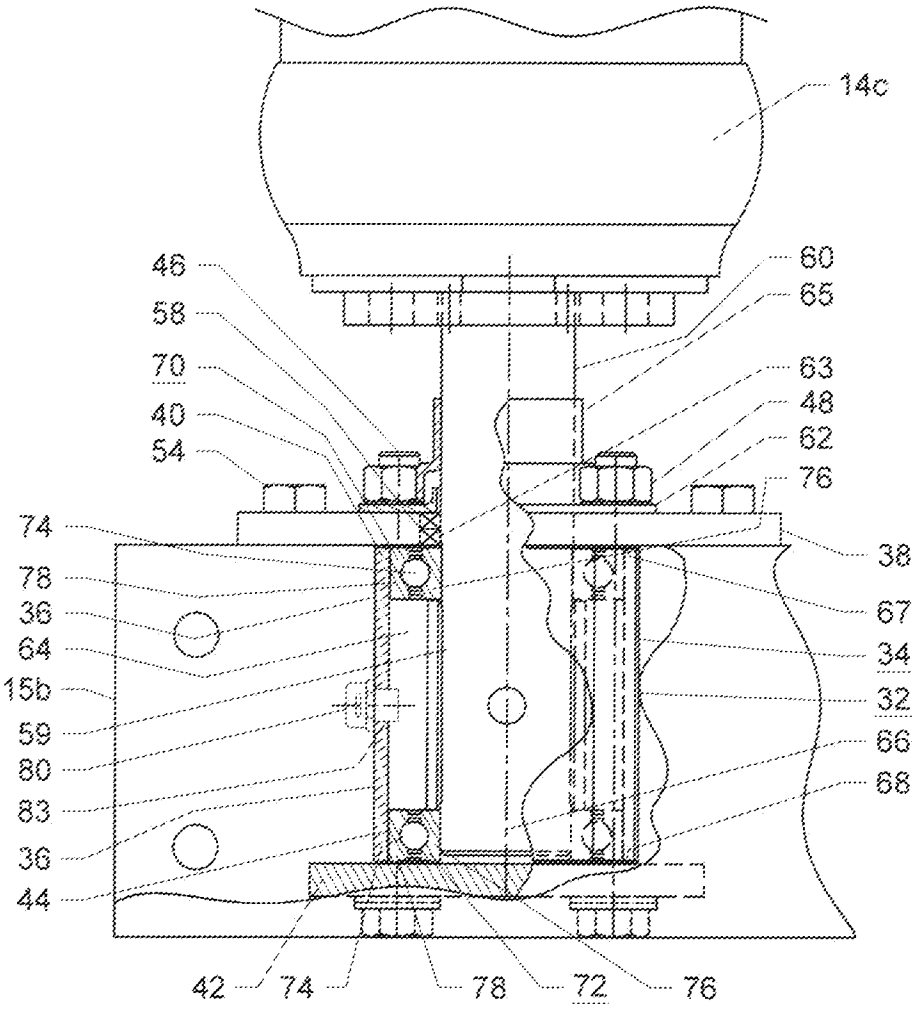
FIG. 3 is an elevational view taken along the line '3'-'3' of FIG. 2.

The bearing assembly 32 includes a sealed bearing housing 34 with a central cylindrical housing portion 36 affixed to a top plate 38 attached to an upper end 40 of the central cylindrical housing portion 36, as shown in FIGS. 2 and 3. Between the upper end 40 of the central cylindrical housing portion 36 and the top plate 38 is an upper housing gasket seal 67. The central cylindrical housing portion 36 is also affixed to a bottom plate 42 attached to a lower end 44 of the central cylindrical housing portion 36. Four plate connecting bolts 46 connect the top plate 38 to the bottom plate 42 by tightened plate connecting nuts 48.

As can be seen in FIG. 2, the top plate 38 is sized larger than the bottom plate 42 so that it sufficiently spans an upper flange 50 of the first U-shaped flanged beam 15*a* and the upper flange 52 of the second U-shaped flanged beam 15*b*. The upper flanges 50, 52 are provided with holes, not shown in the drawings, that align with respective holes, not shown in the drawings, in the top plate 38 in the operative position. Top plate bolts 54 pass through the respective top plate holes and upper flange holes. The top plate bolts 54 are locked in position by top plate nuts 56. The bottom plate 42 is sized so that it fits between the first U-shaped flanged beam 15*a* and the second U-shaped flanged beam 15*b* as shown in FIG. 2.

The top plate 38 has a top plate aperture 58 passing through it, as shown in FIG. 3. A lower shaft portion 59 of a rotating insulator support shaft 60 exits through the housing 34 through the top plate aperture 58. A flange bracket 62 is attached to the top plate 38 as shown in FIGS. 2 and 3. The flange bracket 62 surrounds the circumference of the rotating insulator support shaft 60 and retains double seals 63. The flange bracket 62 may be made of aluminum, for example. Double seals 63, as shown in FIG. 3, surround the lower shaft portion 59 to seal it with respect to an axial chamber 64 formed by the interior hollow space of the housing 34 which surrounds the lower shaft portion 59 of the rotating insulator support shaft 60. The double seals 63 may be made of a weather resistant material such as silicone, for example. In addition, another seal 65 also tightly surrounds the shaft 60 to seal it with respect to the top plate 38. As the shaft rotates, the seal 65 slides on the flange bracket 62, as shown in FIG. 2. The seal 65 may be made of a weather resistant material such as silicone, for example.

The bottom 66 of the lower shaft portion 59 of the rotating insulator shaft 60 is supported by the bottom plate 42 by way of the lower bearing 72. The gasket seal 68 that is positioned on the bottom plate 42 to seal the lower end 44 of the housing 36. The upper and lower housing gasket seals 67 and 68 respectively, are preferably made of weather resistant material such as cork, for example.

The sealed bearing housing 34 of the rotating bearing assembly 32 includes an upper corrodible steel bearing assembly 70 mounted in operative position at the upper end 40 of the central cylindrical housing portion 36 as shown in FIG. 3. The housing 34 also includes a lower corrodible steel bearing assembly 72 mounted in operative position at the lower end 44 of the central cylindrical housing portion 36. The upper corrodible steel bearing assembly 70 and the lower corrodible steel bearing assembly 72 are operatively arranged around the lower shaft portion 59 of the rotating insulator support shaft 60.

The upper corrodible steel bearing assembly 70 and the lower corrodible steel ball assembly 72 both include a plurality of corrodible steel ball bearings 74 or, in the alternative, corrodible steel rollers, not shown in the drawings. Each of the upper corrodible steel bearing assembly 70 and the lower corrodible steel bearing assembly 72 include an inner corrodible steel bearing race 76 and an outer corrodible steel bearing race 78. The steel ball bearings 74 and the inner corrodible steel bearing races 76 and the outer steel bearing races 78 may be made of 52100 bearing steel, which is corrodible steel, for example.

Figure 4:
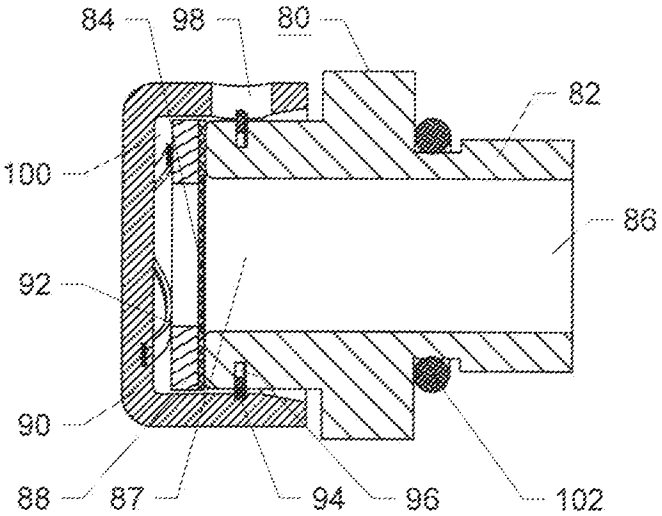
FIG. 4 is a cross-sectional view taken along the line '4'-'4' of FIG. 2.

The rotating bearing assembly 32 of the present invention also includes an air permeable membrane assembly 80 as shown in FIGS. 2, 3 and 4. The air permeable membrane assembly 80 includes a membrane housing 82 that may be made of aluminum or stainless steel, for example. The central cylindrical housing portion 36 is provided with a membrane assembly mounting aperture 83. The membrane housing 82 is mounted in the membrane assembly aperture 83, as shown in as shown in FIGS. 2 and 3. The membrane housing 82 is provided with a membrane housing aperture 86 which vents the axial chamber 64 to the side of the membrane house 82 as shown in FIG. 4. At the entrance or front 87 of the membrane vent housing aperture 86, an air permeable hydrophobic membrane 84 covers the front 87 of the membrane vent housing aperture 86 and acts as a condensing preventing membrane. The air permeable hydrophobic membrane 84 is held in place by a flat washer 88 held in place by a membrane vent housing cap 90 engaging a wave disk spring 92 which cooperates with spiral retaining ring 94 which engages groove 96 in the membrane vent housing 82, as shown in FIG. 4. As can be seen in FIG. 4, the membrane vent housing cap 90 is provided with an opening 98 that permits the axial chamber 64 of the sealed bearing housing 34 to be vented by an ambient air channel 100 between the membrane vent housing cap 90 and the flat washer 88 via opening 98. O-ring 102, made of rubber, such as ethylene-propylene diene monomer, known as "EPDM", a synthetic rubber, for example, seals the membrane assembly mounting aperture 83 when the air permeable membrane assembly 80 is installed in the central cylindrical housing portion 36. The vent housing cap 90 prevents freezing rain, snow and dirt from clogging the air permeable hydrophobic membrane 84.

The air permeable hydrophobic membrane 84 may be a polymer air permeable hydrophobic membrane such as is marketed as a GORE vent. "GORE" is a U.S. registered trademark of W. L. Gore & Associates, Inc., 555 Paper Mill Road, Newark, Del. 19714. Such a type of membrane vent assembly or plug with a polymer air permeable hydrophobic membrane is also described in U.S. Pat. No. 8,734,573 B2, issued May 27, 2014, to Masashi Ono, et al. and assigned to W. L. Gore & Associates, Co., Ltd., Tokyo, Japan.

The air permeable hydrophobic membrane 84 when installed in the bearing assembly 32 keeps the corrodible steel ball bearings 74 or steel rollers and the inner corrodible steel bearing races 76 and the outer corrodible steel bearing races 78 dry and free of water and therefore prevents any corrosion and contamination of these parts that would require repair or replacement of the high voltage switch 10. Also, as mentioned previously, the air permeable hydrophobic membrane 84 keeps the chamber 64 dry and free of water which protects bearing assemblies having corrodible components and/or non-corrodible components, in that the air permeable hydrophobic membrane 84 prevents freezing of water within the chamber, which may cause the components to fail, resulting in switch malfunction, and the membrane 84 also prevents deterioration of any lubricant coating of the bearings or rollers and associated races by inhibiting water infiltration.

Figure 5:
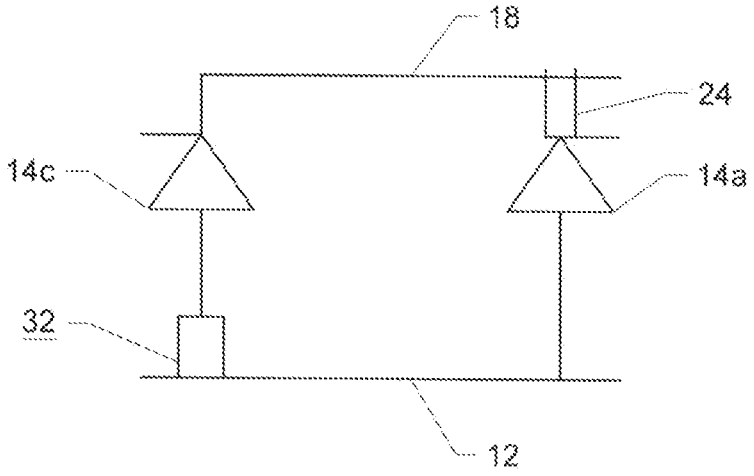
FIG. 5 is a greatly simplified schematic of an elevational view of a side break switch in the closed electrically conductive position.
Figure 6:
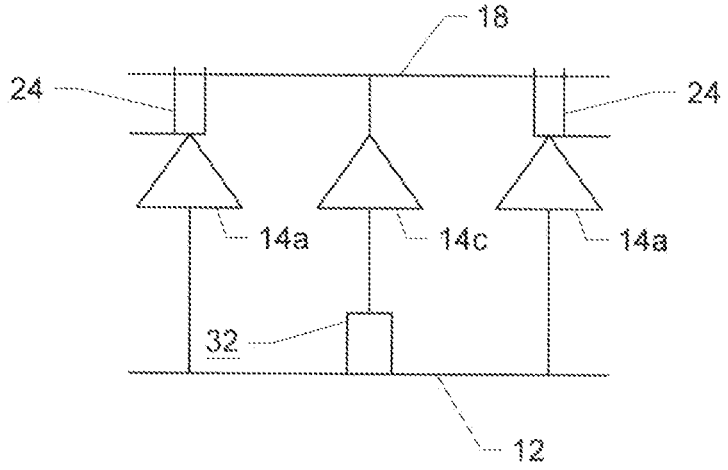
FIG. 6 is a greatly simplified schematic of an elevational view of a double break switch in the closed electrically conductive position; and, FIG. 7 is a greatly simplified schematic of an elevational view of a center break switch in the closed electrically conductive position.
Figure 7:
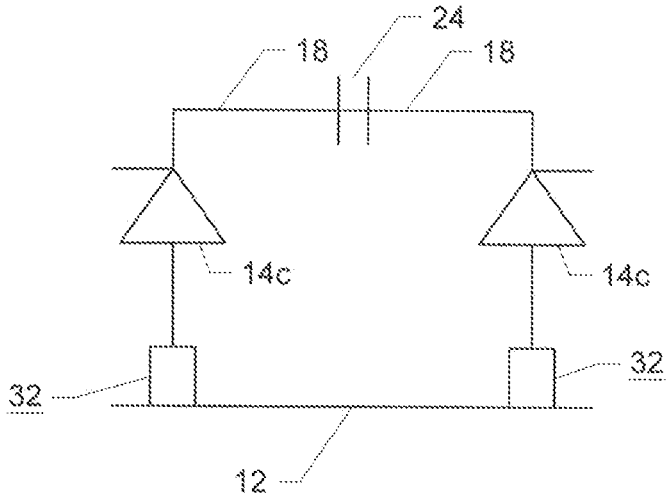

Also, as mentioned previously, the present invention also applies to other types of high voltage disconnect switch types including side break, double break and center break switches shown in FIGS. 5, 6 and 7. With these embodiments like numerals represent like elements of the device. With reference to FIG. 5, a greatly simplified schematic of an elevational view of a side break type high voltage disconnect switch of the present invention is shown. As can be seen from FIG. 5, the side break switch includes a rotating insulator 14*c* positioned on base 12. The rotating bearing assembly 32 of the present invention is in operative arrangement with the rotating insulator 14*c*. The rotating switch blade 18 is shown in a closed conductive position with jaw fingers 24, which are operatively attached to the stationary insulator 14*a*.

With reference to FIG. 6 a greatly simplified schematic of an elevational view of a double break type high voltage disconnect switch of the present invention is shown. As can be seen from FIG. 6 the double break switch includes a rotating insulator 14*c* positioned on base 12. The rotating bearing assembly 32 of the present invention is in operative arrangement with the rotating insulator 14*c*. The rotating switch blade 18 is shown in a closed conductive position with jaw fingers 24 operatively attached to the two stationary insulators 14*a* which contact opposite ends of the switch blade 18.

With reference to FIG. 7 a greatly simplified schematic of an elevational view of a center break type high voltage disconnect switch of the present invention is shown. As can be seen from FIG. 7 the center break switch includes two rotating insulators 14*c* positioned on base 12. Two rotating bearing assemblies 32 of the present invention are each in operative arrangement with a respective rotating insulator 14*c*. The switch includes two rotating switch blades 18 each respectively operatively arranged with one of the rotatable insulators 14*c* as shown in FIG. 7. Both of the rotating switch blades 18 are shown in a closed conductive position with jaw fingers 24. Both rotating switch blades 18 when opening the switch simultaneously rotate away from each other.

A method of preventing condensation within such a high voltage switch bearing assembly 32 is also disclosed. The method comprises the steps of: (a) providing the high voltage switch 10 with the bearing assembly 32 with the membrane assembly 80 as previously described herein; (b) prior to installing the top plate 38 or the bottom plate 42 in the bearing assembly housing 34 lubricating the upper corrodible steel ball bearing assembly 70 and the lower corrodible steel ball bearing assembly 72 with only sufficient lubricant for lubricated rolling of the corrodible steel ball bearings 74 within the respective upper corrodible steel ball bearing assembly 70 and the lower corrodible steel ball bearing assembly 72, while permitting the free space volume of the axial chamber 64 to contain an atmosphere consisting essentially of air that has been prevented from condensing by the air permeable hydrophobic membrane 84. The lubricant for lubricating, for the purpose of lowering the friction, the respective upper corrodible steel ball bearing assembly 70 and the lower corrodible steel ball bearing assembly 72 may be a commercial grease, for example.

What is claimed is:

1. A high voltage electric disconnect switch comprising:

at least one rotating electric insulator, the rotating electric insulator including a rotating bearing assembly comprising a rotating bearing shaft and a sealed bearing housing having an interior that contains ball bearings or rollers and bearing races for operatively opening and closing the electric switch, the sealed bearing housing having an opening therethrough, an air permeable condensation preventing vent mounted in the opening in operative arrangement with the sealed bearing housing, the air permeable condensation preventing vent configured to allow ambient air to flow into and out of the sealed bearing housing only through the air permeable condensation preventing vent while preventing the flow of water into the sealed bearing housing, but allowing air to enter and exit the sealed bearing housing through the air permeable condensation preventing vent while preventing moist air from condensing to keep the interior of the sealed bearing housing dry and free of water, the air permeable condensation preventing vent includes an air permeable hydrophobic membrane configured to keep the interior of the sealed bearing housing dry and free of water, and, the air permeable condensation preventing membrane vent further includes a membrane vent housing in operative engagement with the opening in the sealed bearing housing and mounted thereto, the membrane vent housing operatively configured for carrying the air permeable hydrophobic membrane.

2. The switch of claim 1, wherein the sealed bearing housing further comprises a plurality of seals configured to seal the sealed bearing housing, the air permeable hydrophobic membrane is configured to maintain the air pressure within the interior of the sealed bearing housing equal to the ambient air pressure outside of the sealed bearing housing, wherein the seals of the sealed bearing housing are maintained free of pressure differential that may cause leakage of the bearing seals.

3. The switch of claim 1, wherein the ball bearings or rollers and/or bearing races are comprised of corrodible and/or non-corrodible material, the air permeable hydrophobic membrane is configured to prevent freezing of water within the interior of the sealed bearing housing to prevent impairment of operation of the ball bearings or rollers and/or bearing races and the opening and closing of the high voltage electric disconnect switch.

4. The switch of claim 3, wherein the ball bearings or rollers and/or bearing races are comprised of corrodible metal.

5. The switch of claim 4, wherein the air permeable hydrophobic membrane is configured to keep the corrodible metal ball bearings or corrodible metal rollers and/or corrodible metal bearing races dry and free of water by preventing condensation within the interior of the sealed bearing housing to prevent corrosion of the corrodible metal ball bearings or corrodible metal rollers and/or corrodible metal bearing races.

6. The switch of claim 1, wherein the air permeable condensation preventing vent further includes a membrane vent housing cap in operative arrangement with the air permeable hydrophobic membrane and configured to protect the air permeable hydrophobic membrane from freezing rain and snow and dirt that can clog the air permeable hydrophobic membrane.

7. The switch of claim 1, wherein the membrane vent housing has a membrane vent housing channel passing therethrough in fluid communication with the interior or the sealed bearing housing, the air permeable hydrophobic membrane in operative arrangement with the membrane vent housing channel and the interior of the sealed bearing housing.

8. The switch of claim 4, wherein the corrodible metal ball bearings or corrodible metal rollers and/or corrodible metal bearing races are configured to be lubricant coated for friction reduction.

9. The switch of claim 5, wherein the corrodible metal ball bearings or metal rollers and/or metal bearing races are stainless steel, iron or alloy or corrodible steel or any metal.

10. The switch of claim 3, wherein the ball bearings or rollers and/or bearing races are comprised of non-corrodible ceramic or beryllium copper.

11. The switch of claim 1, wherein the high voltage electric disconnect switch is a vertical break, side break, center break or double break type of air break high voltage disconnect switch.

12. A method of preventing condensation within the rotating insulator bearing assembly of a high voltage disconnect switch comprising the following steps:

a. installing during the assembly of the sealed bearing housing as claimed in claim 1, an air permeable hydrophobic membrane that prevents corrosion of the corrodible metal ball bearings or corrodible metal rollers and/or the corrodible metal bearing races by keeping the corrodible steel ball bearings or corrodible metal rollers and the corrodible metal bearing races dry and free of water; and, b. lubricating during the assembly of the sealed bearing housing only the corrodible metal ball bearings or corrodible metal rollers and/or corrodible metal bearing races for reduction of friction.

13. A high voltage electric disconnect switch comprising:

at least one rotating electric insulator, the rotating electric insulator including a rotating bearing assembly comprising a rotating bearing shaft and a sealed bearing housing having an interior that contains ball bearings or rollers and bearing races for operatively opening and closing the electric switch, the sealed bearing housing having an opening therethrough, an air permeable condensation preventing vent mounted in the opening in operative arrangement with the sealed bearing housing, the air permeable condensation preventing vent configured to allow ambient air to flow into and out of the sealed bearing housing only through the air permeable condensation preventing vent while preventing the flow of water into the sealed bearing housing, but allowing air to enter and exit the sealed bearing housing through the air permeable condensation preventing vent while preventing moist air from condensing to keep the interior of the sealed bearing housing dry and free of water, the air permeable condensation preventing vent includes an air permeable hydrophobic membrane configured to keep the interior of the sealed bearing housing dry and free of water, the ball bearings or rollers and/or bearing races are comprised of corrodible and/or non-corrodible material, the air permeable hydrophobic membrane is configured to prevent freezing of water within the interior of the sealed bearing housing to prevent impairment of operation of the ball bearings or rollers and/or bearing races and the opening and closing of the high voltage electric disconnect switch, the ball bearings or rollers and/or bearing races are comprised of corrodible metal, the corrodible metal ball bearings or corrodible metal rollers and/or corrodible metal bearing races are configured to be lubricant coated for friction reduction, and, the air permeable hydrophobic membrane is configured to prevent deterioration of the lubricant coating by inhibiting water infiltration.

* * * * *